US008581519B2

(12) United States Patent
Kwong et al.

(10) Patent No.: US 8,581,519 B2
(45) Date of Patent: Nov. 12, 2013

(54) CURRENT-SWITCHING LED DRIVER USING DAC TO RAMP BYPASS CURRENTS TO ACCELERATE SWITCHING SPEED AND REDUCE RIPPLE

(75) Inventors: Kwok Kuen (David) Kwong, Davis, CA (US); Lee L. Yang, Hong Kong (HK); Yunlong Li, Hong Kong (CN); Weina Zhou, Shenzhen (CN)

(73) Assignee: Hong Kong Applied Science & Technology Research Institute Co., Ltd., Hong Kong (HK)

( * ) Notice: Subject to any disclaimer, the term of this patent is extended or adjusted under 35 U.S.C. 154(b) by 322 days.

(21) Appl. No.: 13/218,426

(22) Filed: Aug. 25, 2011

(65) Prior Publication Data

US 2013/0049628 A1 Feb. 28, 2013

(51) Int. Cl.
*H05B 37/02* (2006.01)

(52) U.S. Cl.
USPC ..... 315/307; 315/224; 315/308

(58) Field of Classification Search
USPC ..... 315/209 R, 224, 225, 291, 307, 308, 315/185 R, 192, 193
See application file for complete search history.

(56) References Cited

U.S. PATENT DOCUMENTS 7,233,134 B2 6/2007 Huang et al.
7,317,289 B2 * 1/2008 Hung et al. ..... 315/291
2006/0132063 A1 * 6/2006 Hung et al. ..... 315/291
2006/0192728 A1 8/2006 Kim
2009/0322234 A1 12/2009 Chen et al.
2010/0052569 A1 3/2010 Hoogzaad et al.
2010/0231139 A1 9/2010 Beckhoven
2012/0126719 A1 * 5/2012 Van De Maele et al. ..... 315/307

FOREIGN PATENT DOCUMENTS

CN 101835302A A 9/2010

OTHER PUBLICATIONS

First Office Action from China, Jul. 23, 2013.
Linear Technology, "LT3743 High Current Synchronous Step-Down LED Driver with Three-State Control", Data Sheet, p. 1-28, 2009.
Frank, Fabian, "Managing High Current Transient Loads in Battery-Powered Handhelds", EE-Times Asia, p. 1-2, Apr. 2010.

* cited by examiner

*Primary Examiner* — David H Vu
(74) *Attorney, Agent, or Firm* — Stuart T. Auvinen; gPatent LLC

(57) ABSTRACT

A light-emitting diode (LED) driver provides faster rise and fall times for LED current to reduce image sticking and other interference. A standard DC-DC converter provides a sum current that is slowly ramped up and down by a bypass current digital-to-analog converter (DAC). A digital value to the bypass current DAC is ramped up or down before an LED current is turned on or off. When the LED current is turned on, current is shifted from a bypass path to a path through the LED, maintaining a constant sum current from the DC-DC converter. When a different LED is turned on, current is shifted from one LED's path to the other LED's path. Separate LED current DAC's in each LED path and in the bypass path can share the sum current with digital precision. Using a single DAC for the sum current and switches in each path reduces cost.

20 Claims, 12 Drawing Sheets

DC-DC CONVERT
18
V_OUT
I_SUM
10
I_LED1
12
I_LED2
I_BY
C1
32
C2
34
CB
36
VBIAS
CMD_S (DIGITAL VALUES)
SUM CURRENT DAC
26
LED_SW
PRE
LED CURRENT CMD GENERATOR
150

CURRENT-SWITCHING LED DRIVER USING DAC TO RAMP BYPASS CURRENTS TO ACCELERATE SWITCHING SPEED AND REDUCE RIPPLE

FIELD OF THE INVENTION

This invention relates to light-emitting diode (LED) drivers, and more particularly to high-current LED drivers using digital-to-analog converters (DAC's) to switch currents.

BACKGROUND OF THE INVENTION

Light-emitting diodes (LED's) are being used to replace standard lighting to reduce energy consumption. LED's are commonly used as backlighting for liquid crystal displays (LCD's) such as in large displays and television sets, and for smaller displays and projectors, and other applications. A LED-based projector may have Red, Green, and Blue LED's that are switched on and off rapidly to generate light for pixels that may be generated in the optical path. Moving Micro-Electro-Mechanical System (MEMS) micro-mirrors, LCDs, or Liquid Crystal on Silicon (LCoS) may reflect the LED-generated light under control of pixel display data.

Display refresh rates, quality, and resolutions may require that the LED's switch on and off at a high rate, such as 1 MHz. The amount or intensity of light produced depends on the current through the LED's. Relatively high currents may be required for driving the LED's. Special LED driver circuits may be used to drive the LEDs.

FIG. 1A shows a LED driver. LED driver circuit 100 is powered by power supply voltage Vcc. The LED voltage LED_V produced by LED driver circuit 100 is usually above the forward-biased diode drop according to the desired current when LED 10 is turned on by switch 11, and kept constant when LED 10 is turned off by switch 11. A control signal LED_SW applied to switch 11 at the cathode of LED indicates when to turn LED 10 on and off.

LED 10 may have several LED's in parallel, and may have several (N) LED's in series, requiring a higher LED voltage such as N times the diode drop. The LED current LED_I produced by LED driver circuit 100 can be very high when high intensity light is produced.

FIG. 1B highlights an image sticking problem with inadequate LED drivers. It can be quite a challenge to design LED driver circuit 100 to quickly turn the LED current LED_I on and off. When the LED_SW control input is switched on, the LED current LED_I cannot instantly switch on. Instead, LED_I rises over a period of time. The sudden switching on of LED_I can cause the LED voltage LED_V to initially dip, preventing LED 10 from turning on quickly. The intensity of the visible light produced by LED 10 has a delay in rising.

A similar problem can occur when LED_SW is turned off, causing the visible light to remain on for a period of time after the ideal switch point. This extra delay 102 can cause visible artifacts, such as image sticking, an incorrect light and color combination. For example, the red LED can linger on for extra delay 102, causing some red to be added to the next pixel being displayed by the imager panel. When the next pixel is blue, that next pixel may appear purple instead of blue. The slow response due to image sticking may be visible or perceptible to the human eye.

Other problems from extra delay 102 may include loss of brightness and loss of detail. The switching of the large LED current may also cause dips and spikes in the power-supply voltage Vcc and the driver output voltage LED_V. Ringing, oscillation, or ripple may occur on the node due to inductances and parasitic resistances and capacitances. In some applications, the driver output voltage is also shared with other circuits. This ringing may affect circuits in unusual ways, further degrading image performance. Some driver circuits may be effective for low-going transitions but produce excessive delays and ripple for high-going transitions, or vice-versa.

What is desired is a LED driver circuit that reduces current-switching problems such as image sticking. An LED driver that has digital control is also desired. An LED driver that uses digital control of currents to reduce power-supply and ground noise, ringing, and oscillation is also desirable.

DETAILED DESCRIPTION

The present invention relates to an improvement in LED drivers. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

The inventors have realized that the LED itself can withstand sudden changes in current, but the LED driver circuit is more complex and unable to rapidly change currents without creating secondary effects such as power-line noise, ripple, and ringing. Thus the LED driver limits the speed of switching the LED on and off.

While a standard driver such as a DC-DC converter may produce a large current, the DC-DC driver may not be able to switch its current on and off as rapidly as desired, such as at 1 MHz. Also, conventional drivers may not be able to precisely control the current at higher speeds. However, the inventors realize that digital-to-analog converters (DAC's) may be used to precisely control currents, even at high speeds.

The inventors have discovered that a standard DC-DC converter can be used to generate a current that is then switched between a LED and a bypass path using one or more DAC's. The DAC's allow the current from the DC-DC converter to be rapidly switched to and from the LED with the precision of digital control without causing ripple and image sticking since the DC-DC converter is not rapidly changed.

Figure 1A:
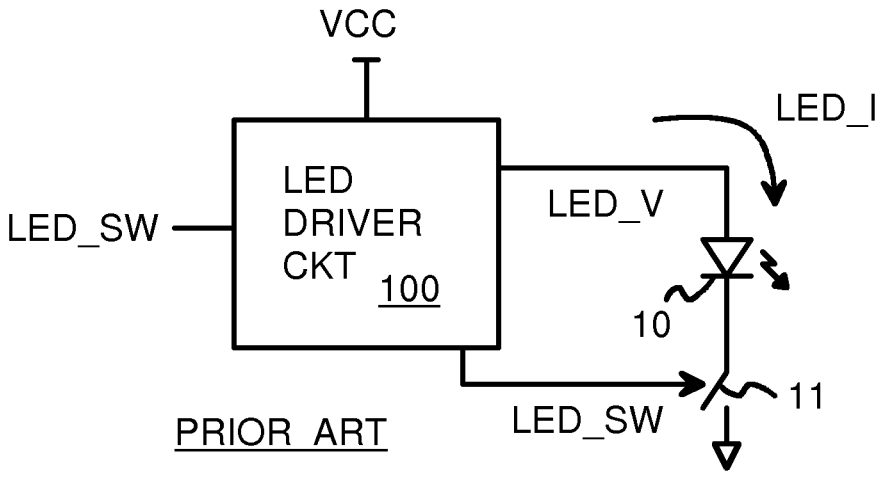
FIG. 1A shows a LED driver.
Figure 1B:
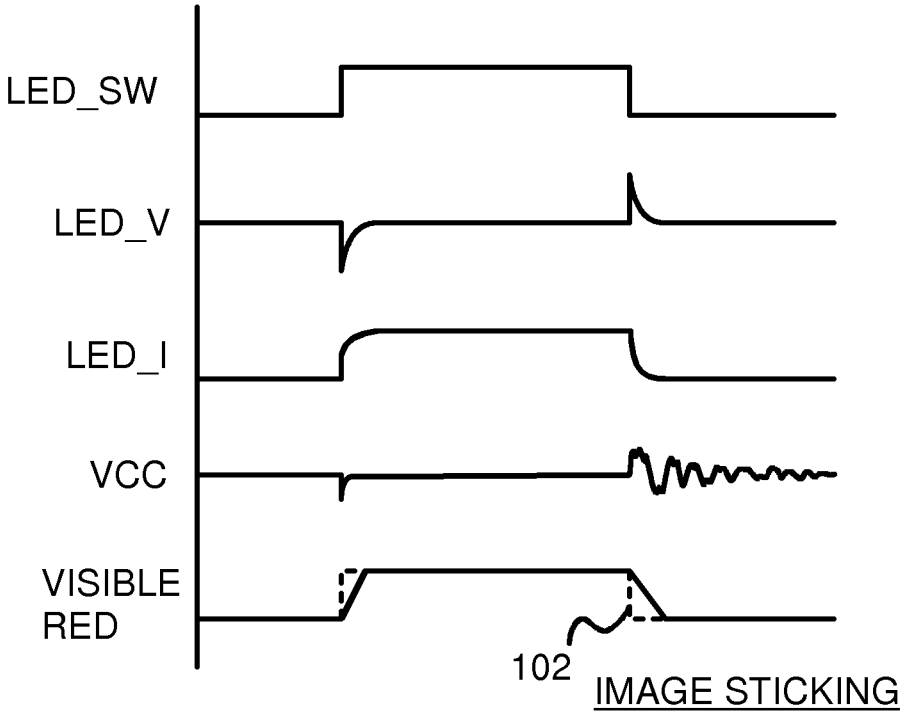
FIG. 1B PRIOR ART
FIG. 1B highlights an image-sticking problem with inadequate LED drivers.
Figure 2:
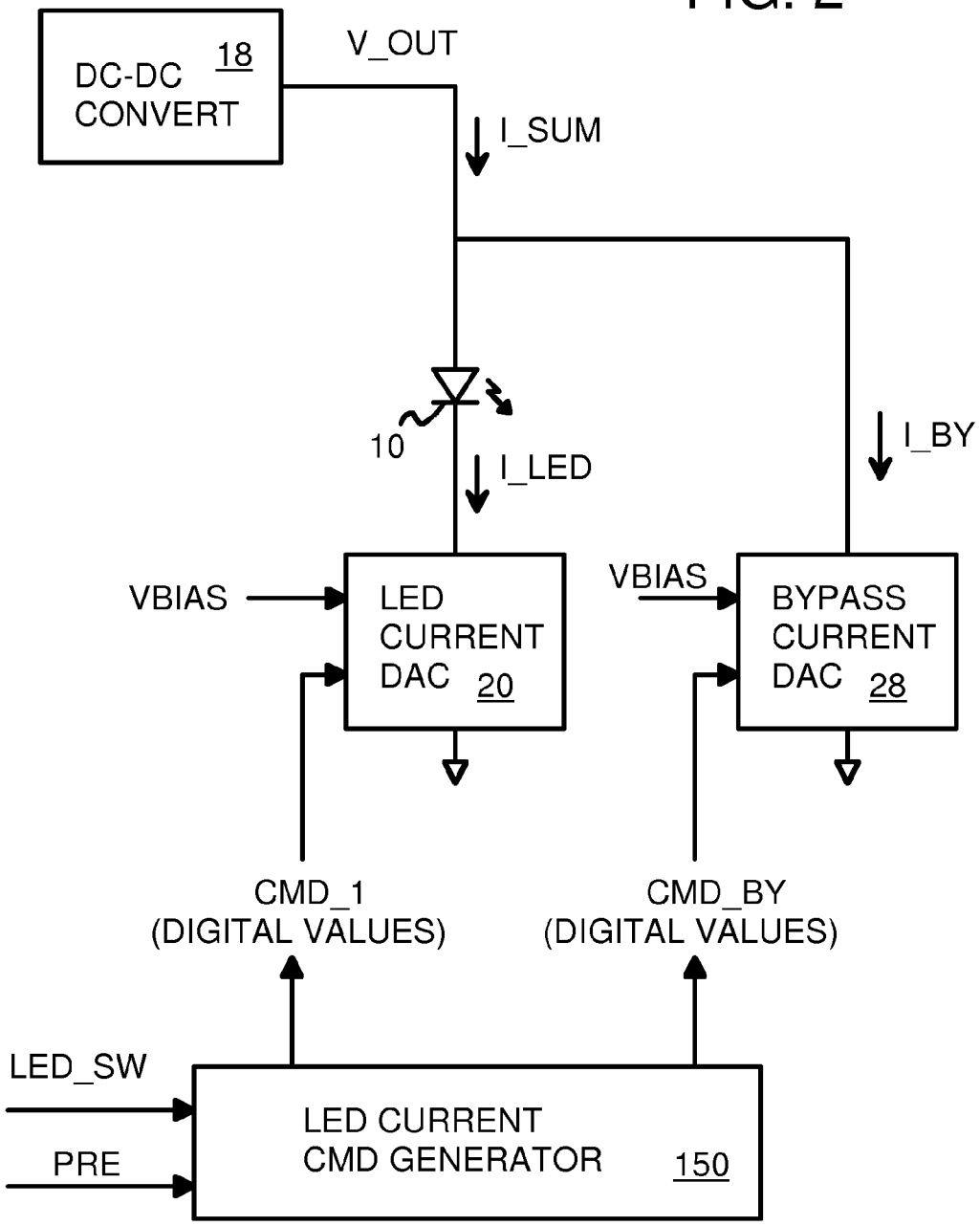
FIG. 2 is a block diagram of a DAC-switched LED driver.

FIG. 2 is a block diagram of a DAC-switched LED driver. DC-DC converter 18 generates a relatively stable current I_SUM from a power-supply voltage (not shown). The DC-DC converter's current I_SUM can travel in two branches. LED current I_LED travels through LED 10 and LED current DAC 20 to ground, while bypass current I_BY passes through bypass current DAC 28 to ground.

The amount of LED current I_LED is controlled by LED current DAC 20, which converts a digital value CMD_1 to an analog current, I_LED. The amount of bypass current I_BY is controlled by bypass current DAC 28, which converts a digital value CMD_BY to an analog current, I_BY.

Bias voltage VBIAS is applied to both LED current DAC 20 and bypass current DAC 28 and serves as a reference. Some embodiments may use a reference current rather than a reference voltage.

Other parts of the system generate signal LED_SW when LED 10 is to be turned on. Signal PRE is generated by pipelining logic, which activates the PRE signal before LED_SW goes high, and keeps PRE on for a period of time after LED_SW goes low. LED current command generator 150 generates sequences of digital values on CMD_1 and CMD_BY to turn LED 10 on and off, and to gradually ramp current before and after LED 10 is illuminated.

Note that the conversion of the digital value CMD_1 to current I_LED may differ from that from CMD_BY to I_BY due to the voltage drop through LED 10 that is not present in the bypass path. Thus the same value of CMD_1 and CMD_BY may produce different currents. A correction to the digital values may be added to CMD_BY to compensate, or the difference in currents may be small enough to be ignored. In the following examples it will be assumed that the differences are ignored, but in an actual system the designer can adjust the digital values for a more optimized result if desired. The bias voltages to LED current DAC 20 and bypass current DAC 28 could also differ and be adjusted to compensate.

Figure 3:
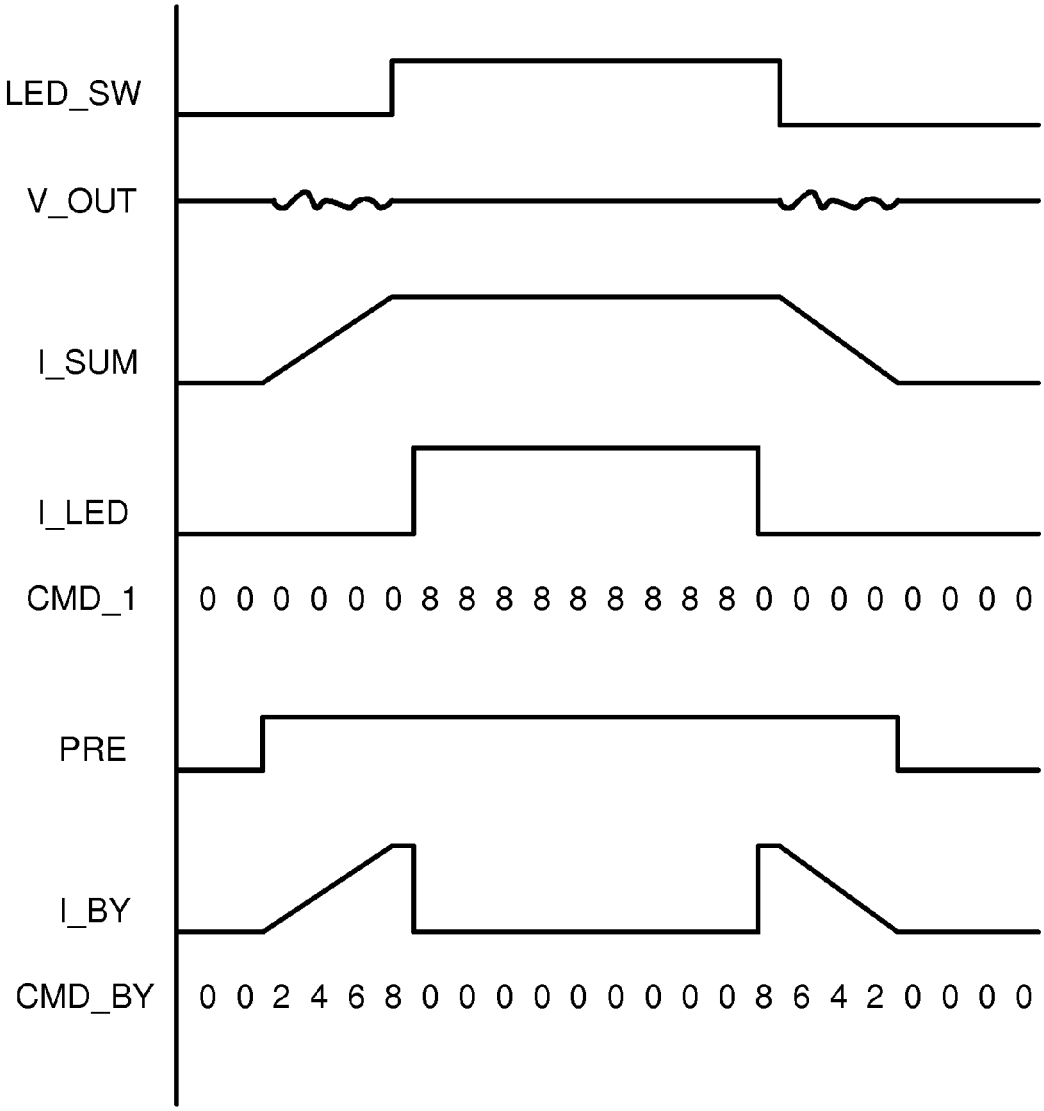
FIG. 3 is a waveform showing operation of the DAC-switched LED driver of FIG. 2.

FIG. 3 is a waveform showing operation of the DAC-switched LED driver of FIG. 2. The LED_SW control input signal goes high to signal that LED 10 is to be turned on. Pipelining logic activates the PRE signal before LED_SW goes high, and keeps PRE on for a period of time after LED_SW goes low.

When PRE initially goes high, the digital value CMD_BY to bypass current DAC 28 is ramped up from the minimum 0 to the desired current value 8, such as in steps 0, 2, 4, 6, 8 as shown. In response to the ramp in the digital values of CMD_BY, bypass current DAC 28 slowly increases current I_BY from zero to the maximum value. The current pulled from DC-DC converter 18, I_SUM, also rises with I_BY since LED current I_LED remains off. Some noise occurs on the output of DC-DC converter 18, V_OUT, as I_SUM is slowly ramped up.

CMD_BY reaches the desired digital value 8 slightly before LED_SW goes high. When I_SUM stops changing, the ripple on V_OUT eventually subsides.

When LED_SW goes high, I_SUM is already at the desired current. CMD_1 is abruptly changed from 0 to 8, causing LED current DAC 20 to quickly increase I_LED from 0 to the desired maximum current. However, current I_SUM drawn from DC-DC converter 18 does not jump, since bypass current I_BY is quickly shut off at the same time that LED current I_LED is turned on. CMD_BY is abruptly changed from 8 to 0, causing bypass current DAC 28 to quickly cut off I_BY.

Since the current from DC-DC converter 18, I_SUM, remains relatively constant as LED 10 is turned on and off, ringing, ripple, and other noise to the power-supply and DC-DC output voltage is avoided. V_OUT from DC-DC converter 18 is stable while LED 10 is on. Image sticking does not occur since LED 10 can be turned on and off rapidly without disturbing DC-DC converter 18.

When LED_SW goes low, I_SUM is still at the desired current. CMD_1 is abruptly changed from 8 to 0, causing LED current DAC 20 to quickly cut I_LED from the desired maximum current to zero. However, current I_SUM drawn from DC-DC converter 18 does not plunge, since bypass current I_BY is quickly turned back on at the same time that LED current I_LED is turned off. CMD_BY is abruptly changed from 0 to 8, causing bypass current DAC 28 to quickly raise I_BY.

PRE is still high after LED_SW goes low. The digital value CMD_BY to bypass current DAC 28 is ramped down from the desired current value 8 to the minimum value 0, such as in steps 8, 6, 4, 2, 0 as shown. In response to the ramp in the digital values of CMD_BY, bypass current DAC 28 slowly decreases current I_BY to zero from the maximum value. The current pulled from DC-DC converter 18, I_SUM, also falls with I_BY since LED current I_LED remains off. Some noise occurs on the output of DC-DC converter 18, V_OUT, as I_SUM is slowly ramped down. However, the speed of the ramp of I_SUM is much slower than the rise and fall of I_LED, allowing for rapid LED switching with slow power-supply-current ramping. Ripple and noise are reduced while the fast LED switching eliminates image sticking.

Figure 4:
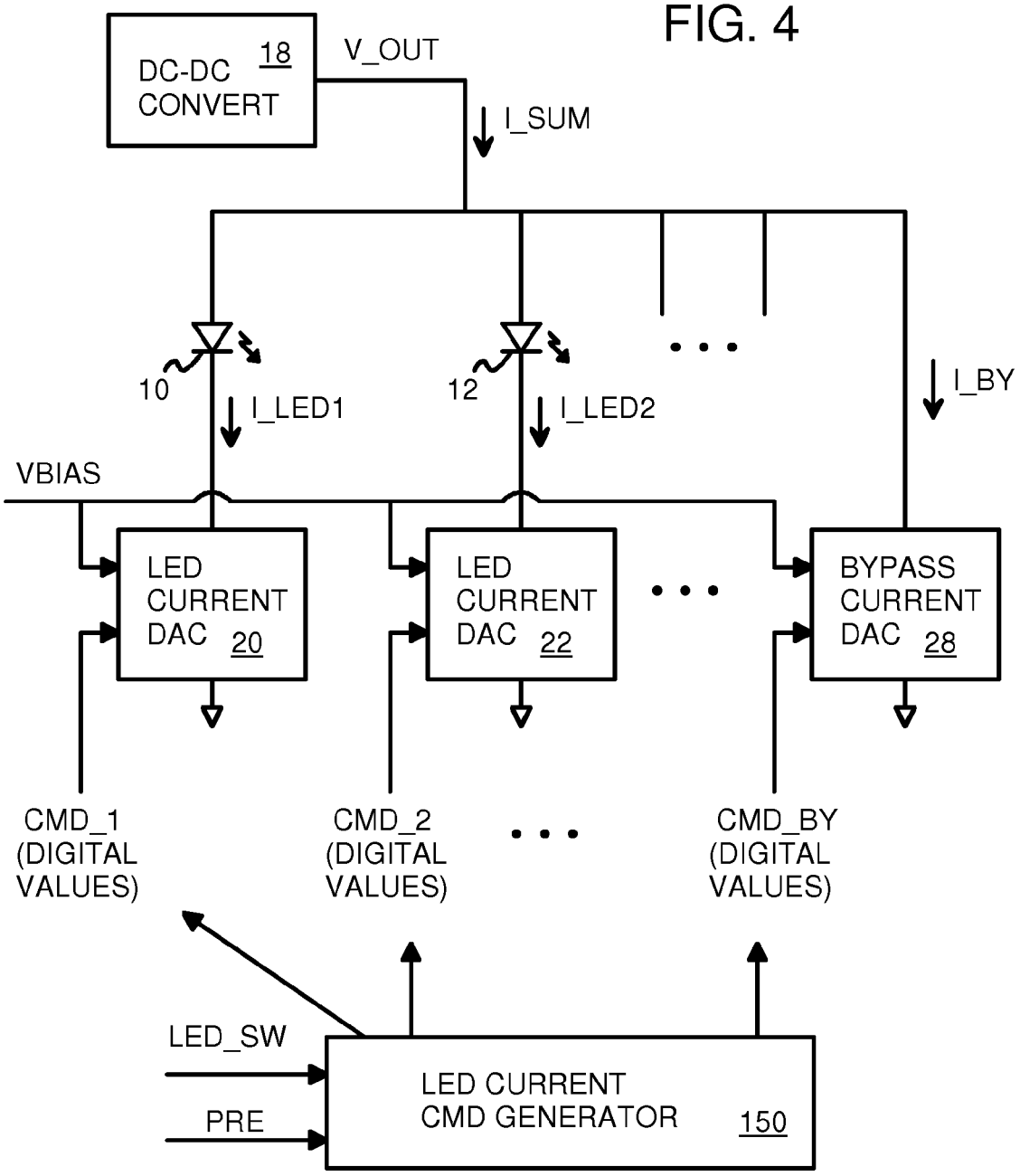
FIG. 4 is a diagram of DAC-switched current among several LED paths and a bypass path.

FIG. 4 is a diagram of DAC-switched current among several LED paths and a bypass path. DC-DC converter 18 provides a total current I_SUM that ramps relatively slowly, reducing power noise. LED's of different visible wavelengths LED 10, LED 12 each have their own current path. LED current DAC 20 controls current I_LED1 through LED 10, while LED current DAC 22 controls current I_LED2 through LED 12. Other DAC's control currents through other LED's (not shown).

Bypass current DAC 28 controls bypass current I_BY, which is the bypass path shared by all LED's 10, 12 . . . . Current can be shifted from one LED 10 to another LED 12 as well as to the bypass. The overall current I_SUM is kept constant by shifting current among LED's and bypass current DAC 28. When all LEDs turn off, bypass current DAC 28 is ramped down slowly to reduce I_SUM.

Other parts of the system generate signal LED_SW when LED 10, 12, . . . is to be turned on. Signal PRE is generated by pipelining logic, which activates the PRE signal before LED_SW goes high, and keeps PRE on for a period of time after LED_SW goes low. LED current command generator 150 generates sequences of digital values on CMD_1, CMD_2, . . . and CMD_BY to turn LED 10, 12, . . . on and off, and to gradually ramp current before and after any of LED 10, 12, . . . is illuminated.

Figure 5:
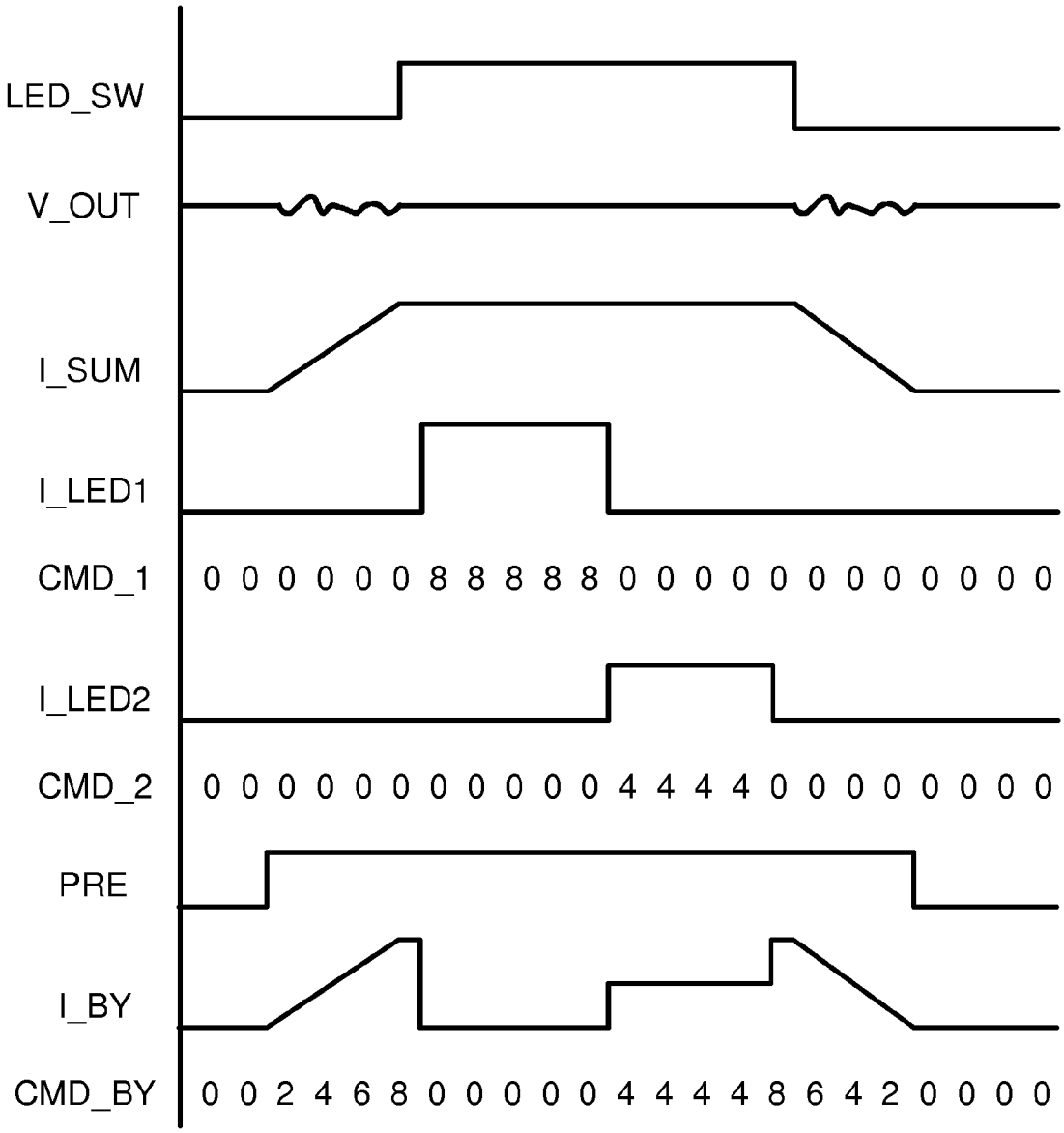
FIG. 5 is a waveform showing operation of the DAC-switched LED driver of FIG. 4.

FIG. 5 is a waveform showing operation of the DAC-switched LED driver of FIG. 4. The LED_SW control input signal goes high to signal that one of LED 10, 12 . . . is to be turned on. Pipelining logic activates the PRE signal before LED_SW goes high, and keeps PRE on for a period of time after LED_SW goes low.

When PRE initially goes high, the digital value CMD_BY to bypass current DAC 28 is ramped up from the minimum 0 to the desired current value 8, such as in steps 0, 2, 4, 6, 8 as shown. In response to the ramp in the digital values of CMD_BY, bypass current DAC 28 slowly increases current I_BY from zero to the maximum value. The current pulled from DC-DC converter 18, I_SUM, also rises with I_BY since LED currents I_LED1, I_LED2 remain off. Some noise occurs on the output of DC-DC converter 18, V_OUT, as I_SUM is slowly ramped up.

When LED_SW goes high, I_SUM is already at the desired current. CMD_1 is abruptly changed from 0 to 8, causing LED current DAC 20 to quickly increase I_LED1 from 0 to the desired maximum current. CMD_BY is abruptly changed from 8 to 0, causing bypass current DAC 28 to quickly cut off I_BY. I_LED2 remains off.

After some time, LED 10 is turned off and LED 12 is turned on, but to a half intensity. CMD_1 is abruptly changed from 8 to 0, causing LED current DAC 20 to quickly cut I_LED1 from the maximum current to zero. CMD_2 is abruptly changed from 0 to 4, causing LED current DAC 22 to quickly increase I_LED2 from 0 to the half the maximum current. CMD_BY is abruptly changed from 0 to 4. Thus half of the I_SUM current flows through bypass current DAC 28, while the other half of the I_SUM current flows through LED 12 and LED current DAC 22 as I_LED2.

Current I_SUM drawn from DC-DC converter 18 does not change, since bypass current I_BY and second LED current I_LED2 are quickly turned on at the same time that LED current I_LED1 is turned off. I_SUM remains at the desired current.

When LED_SW goes low, I_SUM is still at the desired current. CMD_2 is abruptly changed from 4 to 0, causing LED current DAC 22 to quickly cut I_LED2 from half the maximum current to zero. However, current I_SUM drawn from DC-DC converter 18 does not plunge, since bypass current I_BY is quickly turned fully on at the same time that LED current I_LED2 is turned off. CMD_BY is abruptly changed from 4 to 8, causing bypass current DAC 28 to quickly raise I_BY.

PRE is still high after LED_SW goes low. The digital value CMD_BY to bypass current DAC 28 is ramped down from the desired current value 8 to the minimum value 0, such as in steps 8, 6, 4, 2, 0 as shown. In response to the ramp in the digital values of CMD_BY, bypass current DAC 28 slowly decreases current I_BY to zero from the maximum value. The current pulled from DC-DC converter 18, I_SUM, also falls with I_BY since LED currents I_LED1 and I_LED2 remain off. Some noise occurs on the output of DC-DC converter 18, V_OUT, as I_SUM is slowly ramped down. However, the speed of the ramp of I_SUM is much slower than the rise and fall of I_LED1 or I_LED2, allowing for rapid LED switching with slow power-supply-current ramping. Current is shifted among the switching LED's and the bypass path to maintain a constant total current I_SUM.

Figure 6:
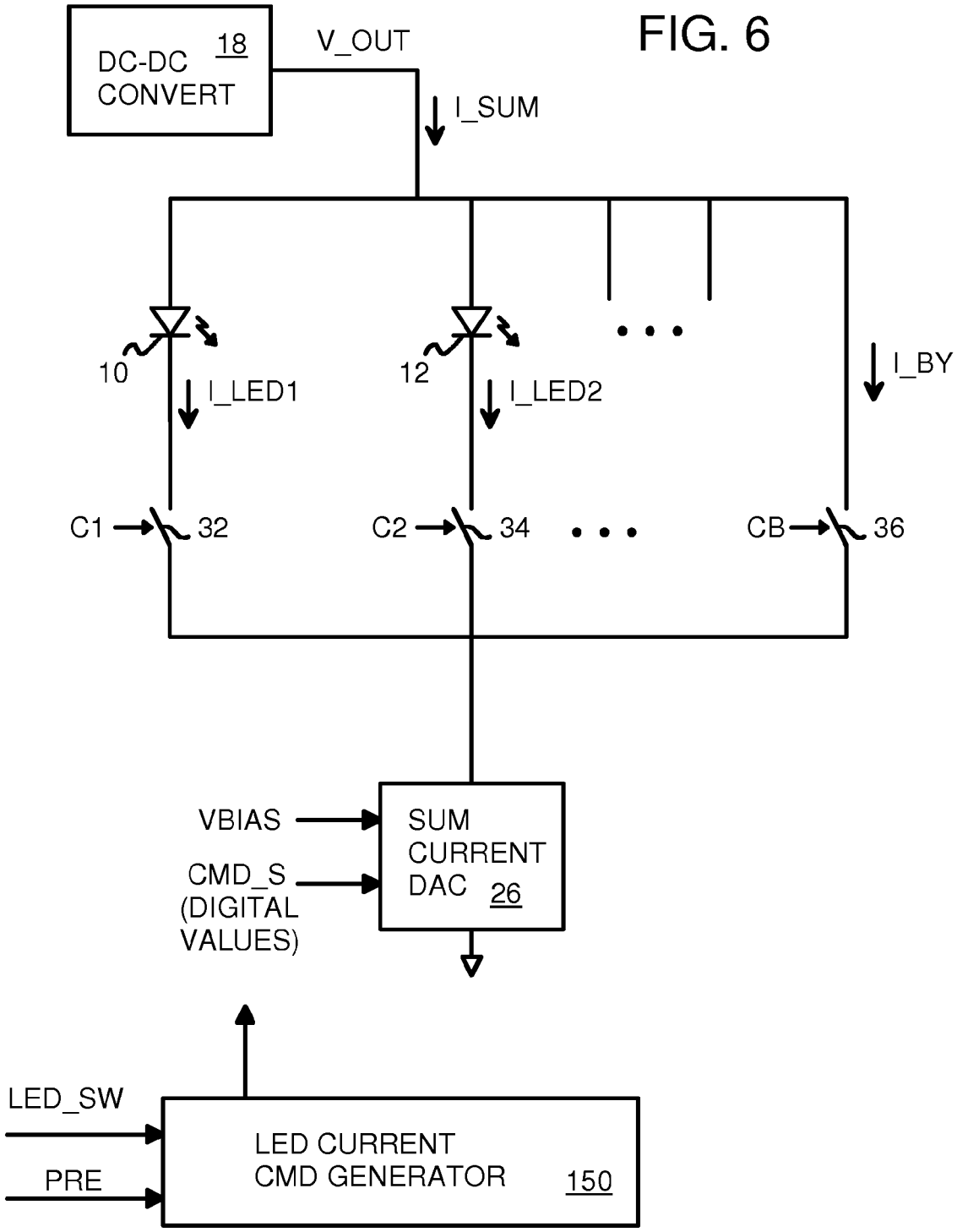
FIG. 6 is a diagram of a shared DAC for switching current among several LED paths and a bypass path.

FIG. 6 is a diagram of a shared DAC for switching current among several LED paths and a bypass path. A single DAC, summing current DAC 26, controls the total current I_SUM in response to digital value CMD_S. Switch 32 turns current I_LED1 on and off in response to control signal C1, allowing current to pass through LED 10. Switch 34 turns current I_LED2 on and off in response to control signal C2, allowing current to pass through LED 12. Other switches control current to other LED's (not shown). Switch 36 turns bypass current I_BY on and off in response to control signal CB. Switches 32, 34, 36 can be n-channel transistor switches, transmission gate switches, or other switch types.

DC-DC converter 18 provides the total current I_SUM that ramps relatively slowly, reducing power noise. LED's of different visible wavelengths LED 10, LED 12 each have their own current path but share summing current DAC 26.

Current can be shifted from one LED 10 to another LED 12 as well as to the bypass path. The overall current I_SUM is kept constant by shifting current among LED's and bypass switch 36. When all LEDs turn off, the bypass current and the overall current through summing current DAC 26 is ramped down slowly to reduce I_SUM.

Other parts of the system generate signal LED_SW when LED 10, 12, or another LED is to be turned on. Signal PRE is generated by pipelining logic, which activates the PRE signal before LED_SW goes high, and keeps PRE on for a period of time after LED_SW goes low. LED current command generator 150 generates sequences of digital values on CMD_S and control signals C1, C2, . . . , CB to turn LED 10, 12 and bypass current I_BY on and off, and to gradually ramp current before and after LED 10, 12, . . . is illuminated.

Figure 7:
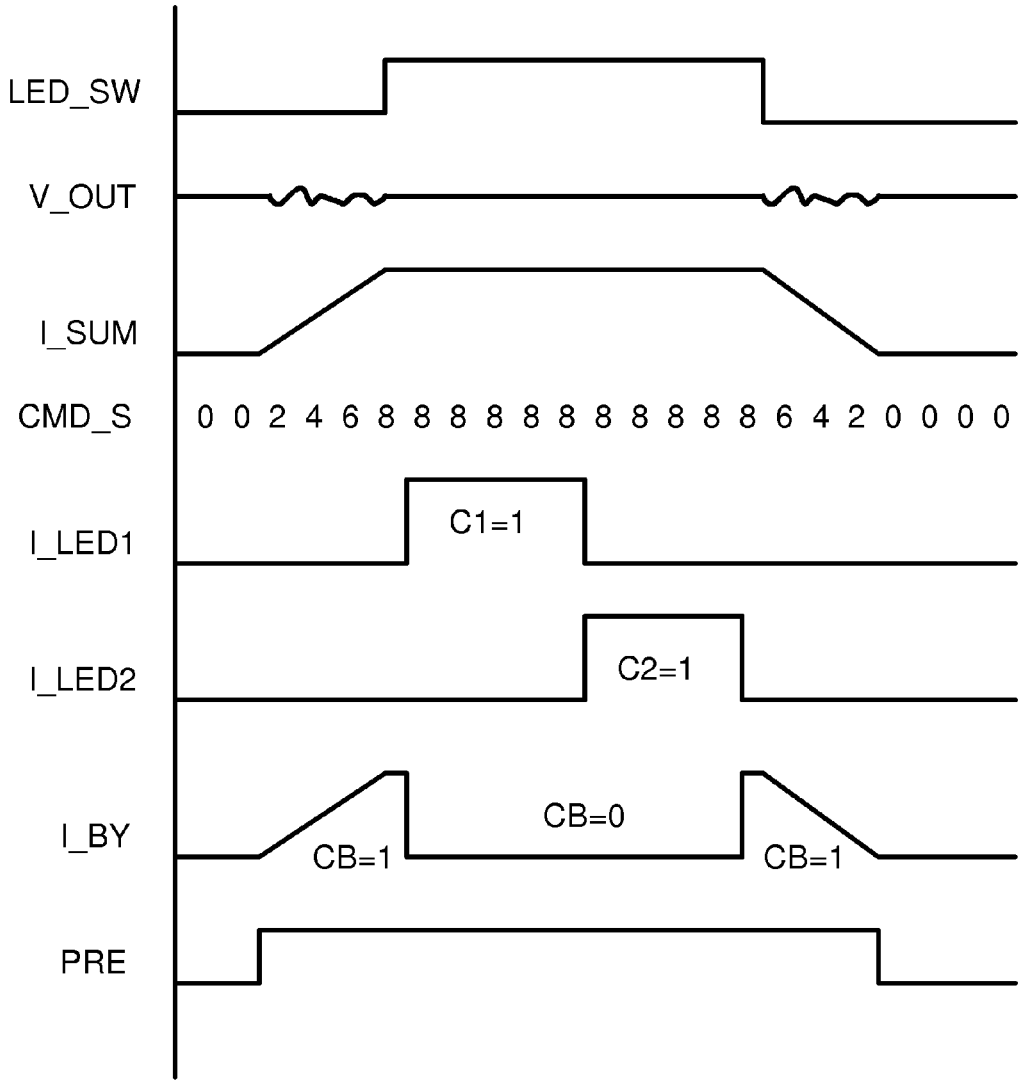
FIG. 7 is a waveform showing operation of the shared-DAC switched-LED driver of FIG. 6.

FIG. 7 is a waveform showing operation of the shared-DAC switched-LED driver of FIG. 6. The LED_SW control input signal goes high to signal that one of LED 10, 12 . . . is to be turned on. Pipelining logic activates the PRE signal before LED_SW goes high, and keeps PRE on for a period of time after LED_SW goes low.

When PRE initially goes high, the digital value CMD_S to summing current DAC 26 is ramped up from the minimum 0 to the desired current value 8, such as in steps 0, 2, 4, 6, 8 as shown. Control signal CB goes high to turn on switch 36 and allow I_SUM to flow as I_BY through the bypass path. C1 and C2 are off to turn off the LED paths.

In response to the ramp in the digital values of CMD_S, summing current DAC 26 slowly increases current I_BY from zero to the maximum value. The current pulled from DC-DC converter 18, I_SUM, also rises with I_BY since LED currents I_LED1, I_LED2 remain off. Some noise occurs on the output of DC-DC converter 18, V_OUT, as I_SUM is slowly ramped up.

When LED_SW goes high, I_SUM is already at the desired current. Control signal C1 is abruptly turned on, causing switch 32 to close and LED current I_LED1 to rise to the desired maximum current. Control signal CB is abruptly turned off, shutting off switch 36 and causing bypass current I_BY to stop. I_LED2 remains off since C2 is low.

After some time, LED 10 is turned off and LED 12 is turned on. Control signal C2 is abruptly turned on, causing switch 34 to close and LED current I_LED2 to rise to the desired maximum current. Control signal C1 is abruptly turned off, shutting off switch 32 and causing LED current I_LED1 to stop. CB is 0 so switch 36 and I_BY remain off.

Current I_SUM drawn from DC-DC converter 18 does not change, since CMD_S remains at 8 and summing current DAC 26 maintains a constant total current.

When LED_SW goes low, I_SUM is still at the desired current. Control signal C2 is abruptly driven low, causing switch 34 to quickly cut I_LED2 to zero. However, current I_SUM drawn from DC-DC converter 18 does not plunge, since bypass current I_BY is quickly turned fully on at the same time that LED current I_LED2 is turned off. Control signal CB is abruptly turned on, causing switch 36 to quickly raise I_BY.

PRE is still high after LED_SW goes low. The digital value CMD_S to summing current DAC 26 is ramped down from the desired current value 8 to the minimum value 0, such as in steps 8, 6, 4, 2, 0 as shown. In response to the ramp in the digital values of CMD_S, summing current DAC 26 slowly decreases current I_BY to zero from the maximum value. The current pulled from DC-DC converter 18, I_SUM, also falls with I_BY since LED currents I_LED1 and I_LED2 remain off.

Current is shifted among the switching LED's and the bypass path to maintain a constant total current I_SUM. However, precise control of partial currents among the paths is not as easily provided as with the separate DAC's of FIG. 4. Costs are reduced since a single DAC is used in this embodiment.

Figure 8:
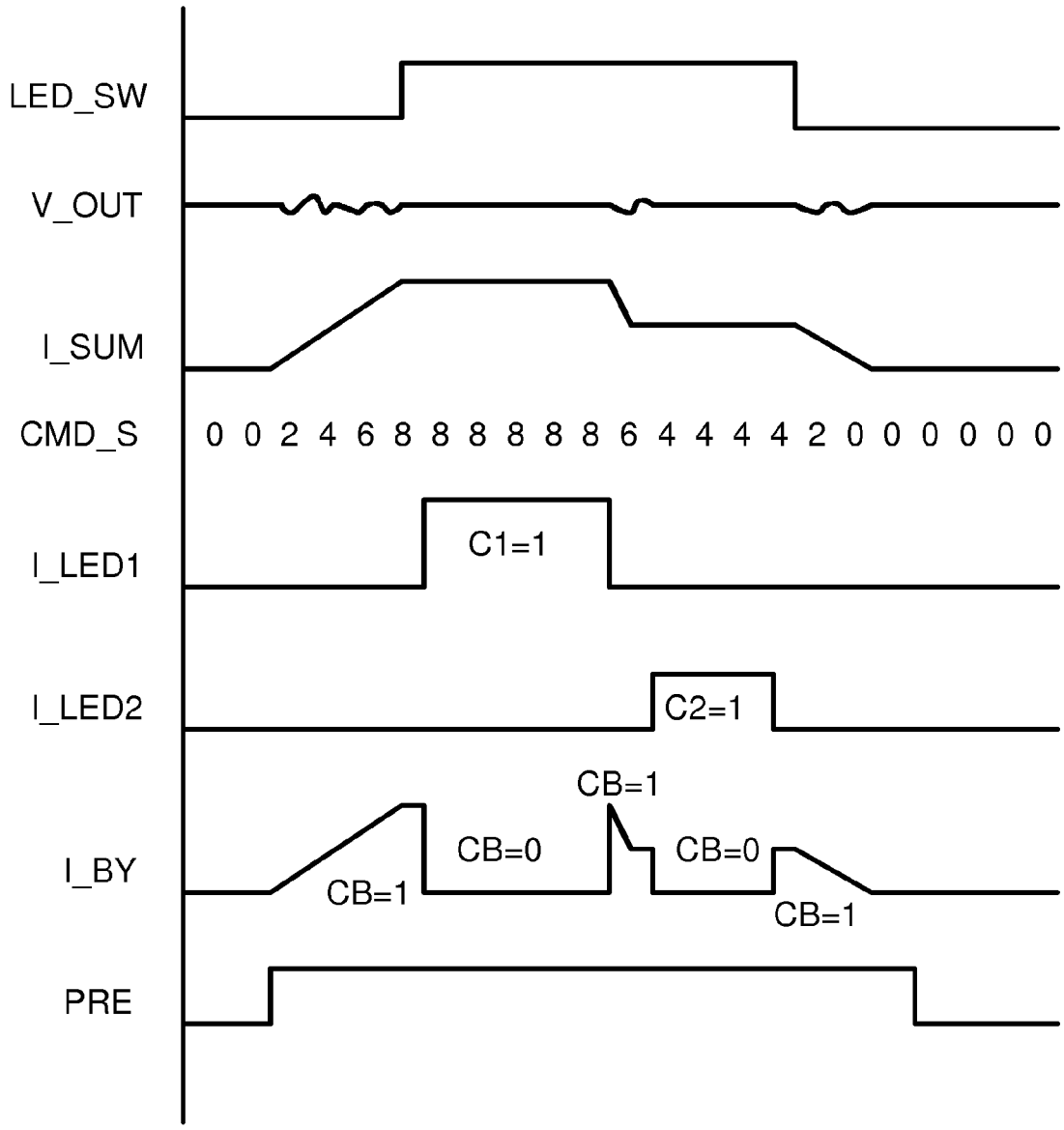
FIG. 8 is a waveform showing operation with reduced currents of the shared-DAC switched-LED driver of FIG. 6.

FIG. 8 is a waveform showing operation with reduced currents of the shared-DAC switched-LED driver of FIG. 6. FIG. 8 is similar to FIG. 7, except that LED 12 is turned on to a half intensity. After LED 10 and I_LED 1 have been on for the desired time, a slight delay occurs before LED 12 and I_LED2 are turned on. When control signal C1 turns off, bypass control signal CB turns on and C2 remains off. Then CMD_S is ramped down from the full value 8 to the half value 4. This causes summing current DAC 26 to reduce I_BY and I_SUM from the full current to a half current.

Once summing current DAC 26 is providing the half current value, control signal CB is driven low to turn off bypass switch 36, causing bypass current I_BY to drop to zero. Control signal C2 is driven high, turning on switch 34 and causing I_LED2 to flow at the half current level.

After LED 12 has been on for the desired time, control signal C2 is turned off and bypass control signal CB is turned on, shifting current from LED 12 to the bypass path. Then CMD_S is ramped down from the half value 4 to zero. This causes summing current DAC 26 to reduce I_BY and I_SUM from the half current to zero.

Some ripple on power output V_OUT from DC-DC converter 18 occurs when summing current DAC 26 ramps current I_SUM up or down. This occurs after PRE is activated and before LED_SW is activate, and at the end when LED_SW is deactivated and PRE is still on. Also, some ripple occurs when the current level of I_SUM is reduced from the full value to the half value between C1 and C2 pulses.

Figure 9:
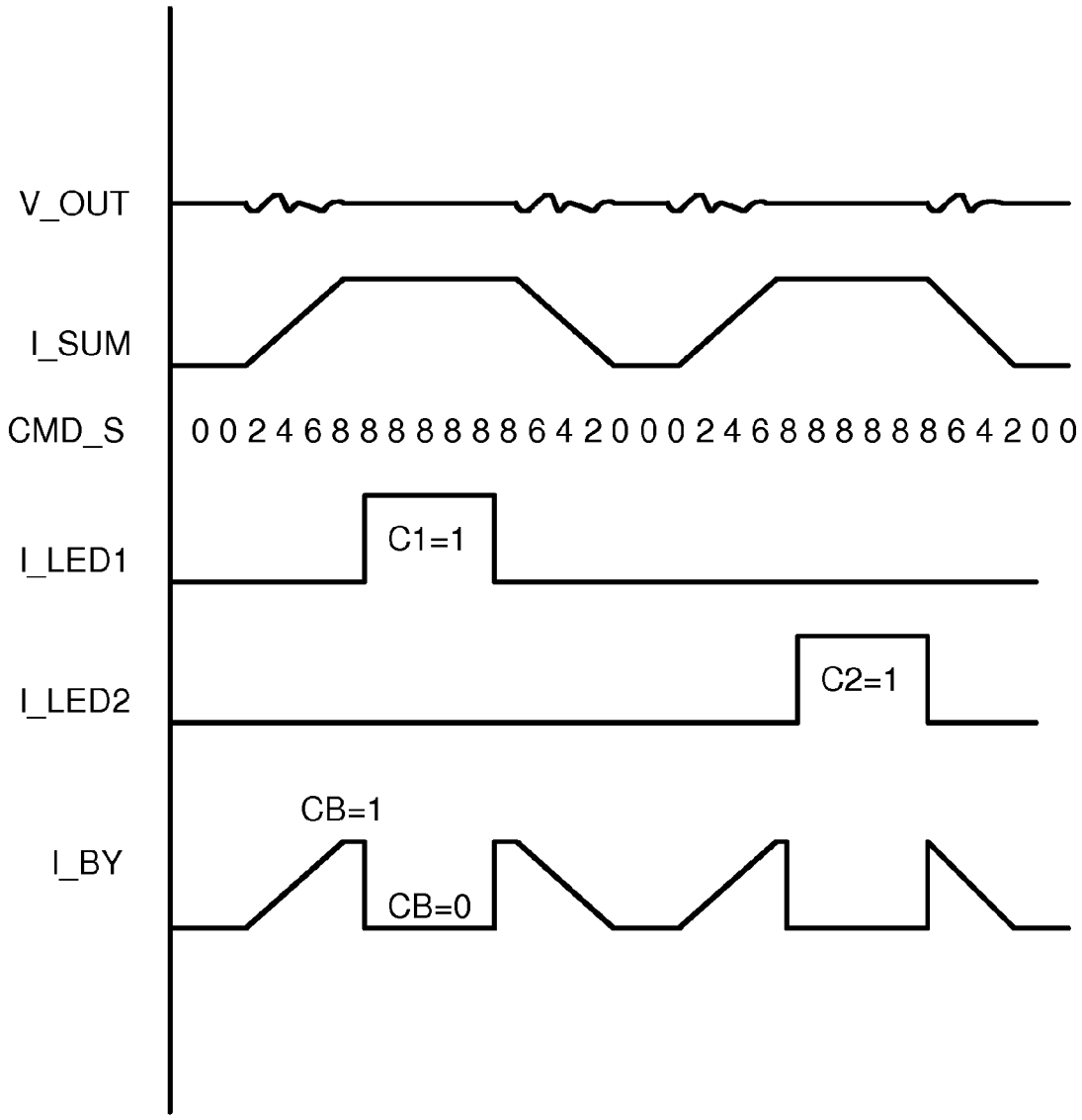
FIG. 9 is a waveform showing power down between LED pulses.

FIG. 9 is a waveform showing power down between LED pulses. When the time between LED pulses is sufficiently large, I_SUM can be powered down. I_SUM is ramped up before LED 10 is turned on and ramped down after LED 10 is turned off. Control signal CB is high during ramping and low when control signal C1 is high to shift current to LED 10.

Some time after I_SUM is ramped down to zero, the next LED pulse is ready to occur. I_SUM is again ramped up before LED 12 is turned on and ramped down after LED 12 is turned off. Control signal CB is high during ramping and low when control signal C2 is high to shift current to LED 12.

Ripple occurs during ramping by summing current DAC 26. However, power is saved when summing current DAC 26 turns off current. The amount of the time gap between LED pulses is decided by the specific application. The ramp speed can be adjusted as a trade off between power consumption and power line noise.

Figure 10:
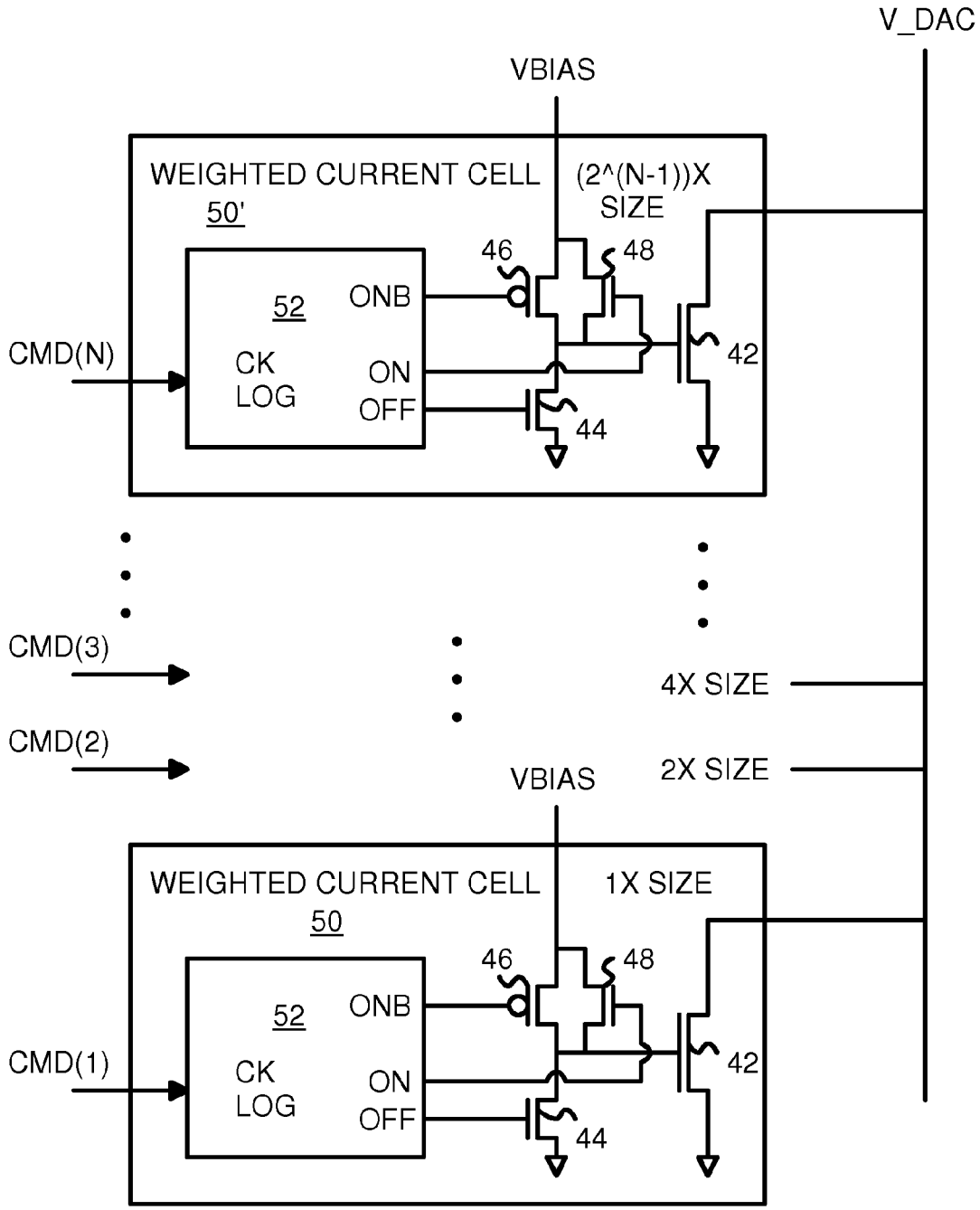
FIG. 10 is a schemantic of a current-weighted array digital-to-analog converter (DAC).

FIG. 10 is a schemantic of a current-weighted array digital-to-analog converter (DAC). Many kinds of DAC's may be employed. A current-weighted array may be used for LED current DAC 20, summing current DAC 26, and bypass current DAC 28. Each successive weighted current cell 50, 50' produces double the current of the prior cell. An N-bit DAC can have N cells 1, 2, 4, . . . N−1, N. Current-weighted transistors 42 in each successive cell is double the size (W/L) of the same current-weighted transistor 42 in the prior cell to produce double the current. A temperature code architecture could also be used to reduce the mismatch noise.

The digital value such as CMD_1, CMD_BY, or CMD_S has N bits that are applied to different weighted current cells 50, 50'. The cell's digital-value bit is input to clock logic 52 which generates signals OFF, ON, ONB for that cell. When the cell's digital-value bit is high, ON is high, turning on n-channel transistor 48 and ONB is low turning on p-channel transistor 46, driving high voltage VBIAS onto the gate of current-weighted transistor 42, so that current-weighted transistor 42 is turned on.

When the cell's digital-value bit is low, OFF is high, turning on n-channel transistor 44, grounding the gate of current-weighted transistor 42, so that current-weighted transistor 42 is turned off. Having switches at the gate of current-weighted transistor 42 as shown can reduce the chip size. Signals ON, OFF, and ONB can be non-overlapping to control power and switch noise.

Figure 11:
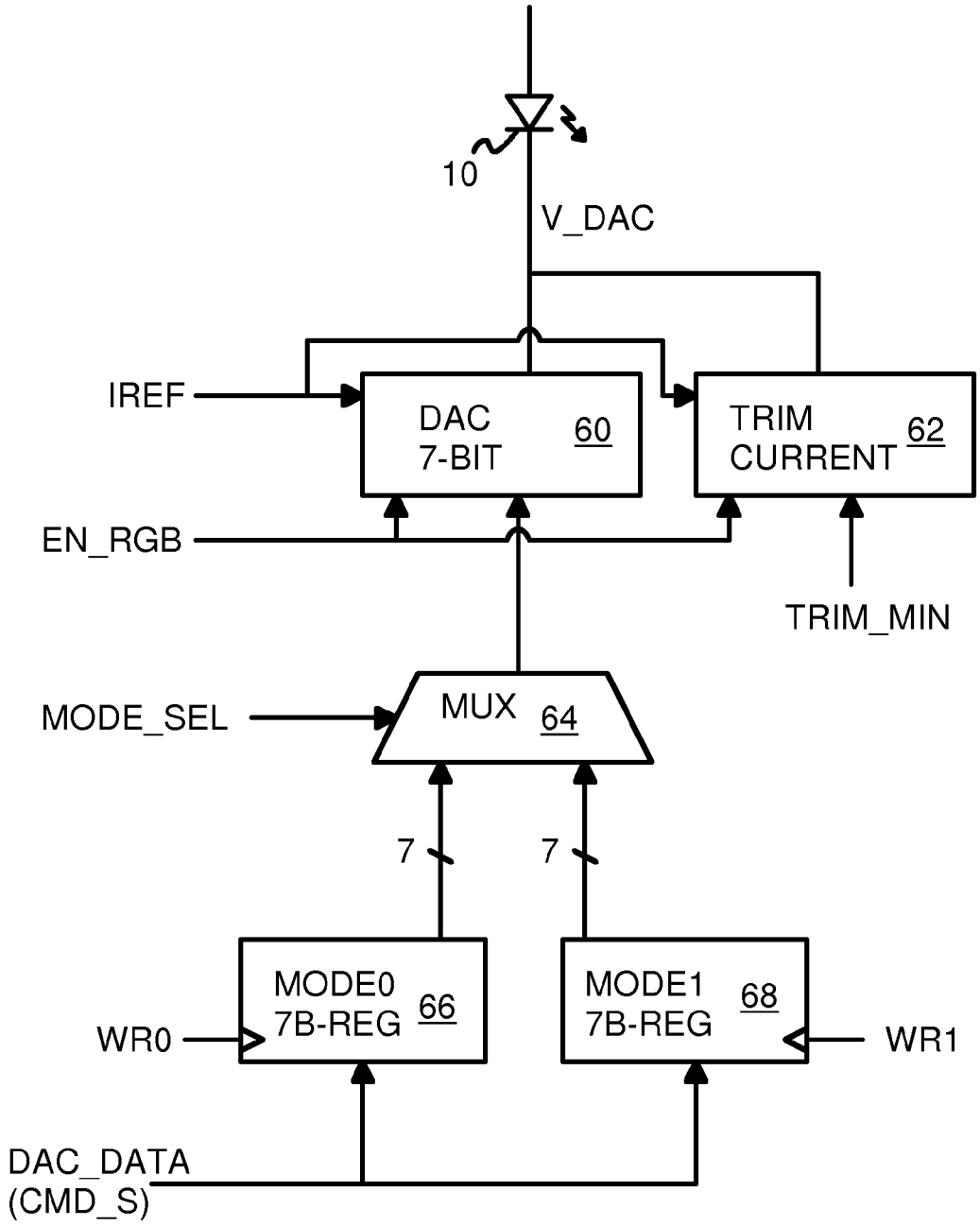
FIG. 11 is a block diagram of a LED current DAC that toggles between two settings.

FIG. 11 is a block diagram of a LED current DAC that toggles between two settings. LED current is pulled through LED 10 by 7-bit DAC 60, which can be a current-weighted DAC as shown in FIG. 10. The minimum on current is generated by trim current cell 62 in response to a trim signal TRIM_Min. A reference current IREF is applied to both 7-bit DAC 60 and LSB DAC current cell 62. An enable signal EN_RGB is also applied to both 7-bit DAC 60 and LSB DAC current cell 62 to enable current flow through LED 10.

The 7 MSB's are provided as the digital value input to 7-bit DAC 60 by mux 64. The pixels may be controlled by a LCD panel in a projector, while the intensity to the LCD panel at a given time is controlled by LED 10. LED 10 can be illuminated to one of two values. In mode 0, LED 10 is illuminated fully, but in mode 1 LED 10 is illuminated only partially. Mode 0 can be a full-power mode while mode 1 is a power-savings mode.

MODE_SEL is applied to the select input of mux 64 and selects the output of mode 0 register 66 when MODE_SEL=0, but selects the output of mode 1 register 68 when MODE_SEL=1. The 7-bit digital value DAC_DATA (such as CMD_1, CMD_2, CMD_BY, CMD_S) is written into mode 0 register 66 when WR0 is pulsed. The digital value is written into mode 1 register 68 when WR1 is pulsed. Thus the system can quickly switch between two modes of lighting LED 10.

Figure 12:
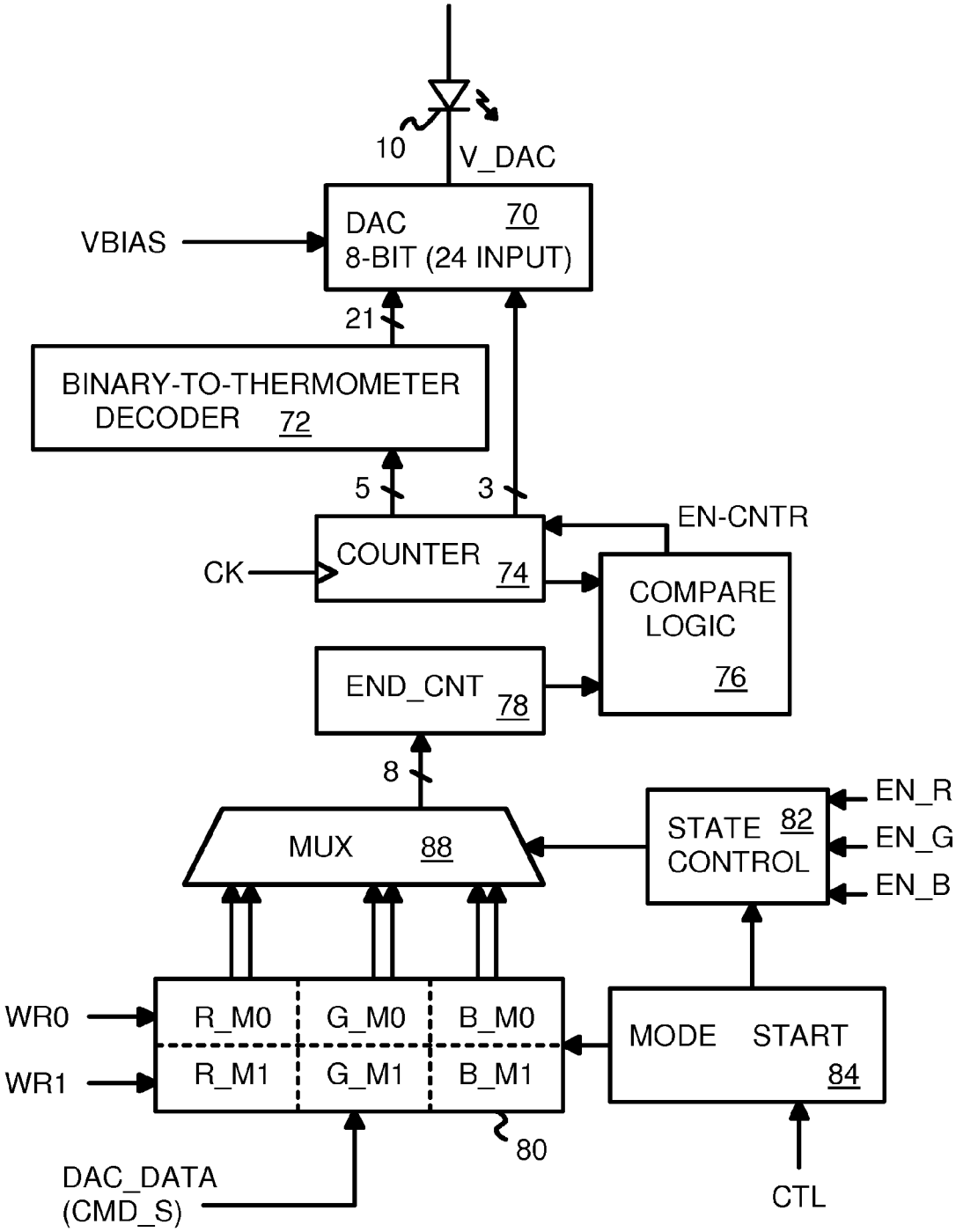
FIG. 12 is a diagram of a shared LED current DAC with look-ahead ramping.

FIG. 12 is a diagram of a shared LED current DAC with look-ahead ramping. In FIG. 11, the user or a processor may input a sequence of values of CMD_S to ramp the bypass current at the appropriate times. In FIG. 12, logic generates the ramp sequences.

LED 10 and any other LED's and bypass paths sink current to 8-bit DAC 70. A bias voltage is applied to 8-bit DAC 70. The digital input to 8-bit DAC 70 is a 24-bit thermometer code to 8-bit DAC 70. The 5 MSB's of the 8-bit binary data are converted to a 21-bit thermometer code that control 21 equal-weighted current cells in 8-bit DAC 70. The last 3 LSB's of the 8-bit binary data are directly applied to 8-bit DAC 70 and control three binary-weighted current cells in 8-bit DAC 70.

Thermometer decoder 72 converts an 8-bit binary code from counter 74 to a 24-bit thermometer code applied to 8-bit DAC 70. Counter 74 counts up or down to generate the ramp sequence, such as 0, 2, 4, 6, 8 shown in the waveforms, but using a finer step. For example, counter 74 may count from 0 to 31 in steps of 1 when ramping up current. The period of clock CK determines the ramp time.

Compare logic 76 enables counter 74 to count up or down, and compares the count value in counter 74 to a target count, such as zero when counting down, or when counting up a maximum value such as was shown as 4 or 8 in the waveforms. The target count can be stored as END_CNT in target register 78 for easy comparison by compare logic 76.

The 8-bit digital value on DAC_DATA (such as CMD_1, CMD_2, CMD_BY, CMD_S) is written into registers 80 for mode 0 when WR0 is pulsed, or for mode 1 when WR1 is pulsed. Digital values are stored for the two power modes for the three primary colors, R, G, B, for a total of six digital values stored in registers 80. Mux 88 selects one of these six stored digital values as the target count stored into target register 78 depending on the power mode and the color of the pixel enabled by inputs EN_R, EN_G, EN_B applied to state control 82. The current generated by 8-bit DAC 70 is ramped up or down to the target count in target register 78 over a period of several clocks CK.

Mode start logic 84 looks ahead in the data stream to detect the next pixel color LED to be turned on or off. Before the time for that next LED to be illuminated or extinguished, mode start logic 84 selects the digital value from registers 80 for loading into target register 78. State control 82 then causes compare logic 78 to begin counting toward the target from the current digital value. Thus the current generated by 8-bit DAC 70 is ramped from its current value to the target value before LED 10 is turned on or off.

The system can quickly switch between two modes of lighting LED 10 by mode start logic 84 selecting from among two illumination levels for each primary pixel color.

Alternate Embodiments

Several other embodiments are contemplated by the inventors. For example the LED could be placed between LED current DAC 20 and ground and still be in series with LED current DAC 20. The rise time of the LED current may be reduced from 7 μs to 1 μs when the switched-DAC circuit replaces a conventional LED driver circuit. Rise and fall times for LED current may be vastly improved. Ripple may be reduced significantly in amplitude and duration.

High LED currents may be rapidly switched, reducing delays that can produce image sticking and other visible distortions. The LED currents may be switched 5 or 10 times faster than the ramp of the sum current from DC-DC converter 18. A standard DC-DC converter 18 may be employed, reducing cost. Other kinds of power supplies and converters may be substituted. Instability from a feedback loop can be avoided, resulting in a more stable design. The DAC's can be integrated with the other circuitry for reduced costs and complexity.

While LED drivers for displays has been described, the LED's could produce other kinds of light or radiation, such as ultraviolet, infrared, or laser light. The LED driver may be useful for laser driver circuits, where a laser diode replaces the visible-light LED. Various colors of visible light may be produced by LED's, and combinations of colors may be substituted for certain applications.

While a single LED in a path has been shown, each single LED may be replaced by an array of LED's, such as several LED's in series (with a higher overall voltage drop), or in parallel (with a higher current). Arrays of LED's can produce more light and may be more efficient in some applications. Thus each path in the LED driver may drive an array of LED's.

The circuit of FIG. 11 can be replicated for other LED's, such as for LED 12. For a RGB system, three such circuits may be used. The circuit of FIG. 11 could also be shared among three LED's such as shown in FIG. 6. The trim signal to LSB DAC current cell 62 can be used to set the minimum current through LED 10, such as 20 mA.

While two illumination levels for each primary-color pixel have been shown, more than two levels could be stored, or just a single level stored. Many arrangements of blocks and functions in FIGS. 11, 12 are contemplated, and pipeline registers, inversions, buffers, and other logic may be added for a variety of purposes. The size and resolution of the DAC can be adjusted depending on the application. DAC's can be implemented in a variety of ways and in various technologies.

While a binary-weighted DAC and a thermometer DAC have been shown, other kinds of DAC's and encodings are possible. LSB DAC current cell 62 could receive a digital value input rather than a trim value, or a multi-bit trim value may be used with several LSB DAC current cells 62. The ramping does not have to be linear as shown, but could have various shapes that might produce less ripple or that meet other design goals. The rate of the ramp could also be varied.

Additional components may be added at various nodes, such as resistors, capacitors, inductors, transistors, etc., and parasitic components may also be present. Enabling and disabling the circuit could be accomplished with additional transistors or in other ways. Pass-gate transistors or transmission gates could be added for isolation. Inversions may be added, or extra buffering. The final sizes of transistors and capacitors may be selected after circuit simulation or field testing. Metal-mask options or other programmable components may be used to select the final capacitor, resistor, or transistor sizes.

P-channel rather than n-channel transistors (or vice-versa) may be used for some technologies or processes, and inversions, buffers, capacitors, resistors, gates, or other components may be added to some nodes for various purposes and to tweak the design. Timings may be adjusted by adding delay lines or by controlling delays. Separate power supplies and grounds may be used for some components. Various filters could be added. Active low rather than active high signals may be substituted.

While positive currents have been described, currents may be negative or positive, as electrons or holes may be considered the carrier in some cases. Source and sink currents may be interchangeable terms when referring to carriers of opposite polarity. Currents may flow in the reverse direction. A fixed bias voltage may be switched to power or ground to power down the circuit.

While Complementary-Metal-Oxide-Semiconductor (CMOS) transistors have been described, other transistor technologies and variations may be substituted, and materials other than silicon may be used, such as Galium-Arsinide (GaAs) and other variations.

The background of the invention section may contain background information about the problem or environment of the invention rather than describe prior art by others. Thus inclusion of material in the background section is not an admission of prior art by the Applicant.

Any methods or processes described herein are machine-implemented or computer-implemented and are intended to be performed by machine, computer, or other device and are not intended to be performed solely by humans without such machine assistance. Tangible results generated may include reports or other machine-generated displays on display devices such as computer monitors, projection devices, audio-generating devices, and related media devices, and may include hardcopy printouts that are also machine-generated. Computer control of other machines is another tangible result.

Circuits may be inverted or reversed. Negative rather than positive currents may flow. Various supply voltages may be substituted, such as positive or negative power supplies, grounds, neutrals, etc.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claim elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A digital-to-analog converter (DAC)-switched light-emitting diode (LED) driver comprising:

a DC-DC converter that generates a sum current on a sum node;

a first LED path having a first LED and a first DAC in series between the sum node and a supply node;

a first digital input to the first DAC, the first digital input for carrying a first digital value, the first DAC generating a first current through the first LED, the first current being a function of the first digital value;

a bypass path having a bypass DAC between the sum node and the supply node;

a bypass digital input to the bypass DAC, the bypass digital input for carrying a bypass digital value, the bypass DAC generating a bypass current through the bypass path, the bypass current being a function of the bypass digital value;

a ramp controller that generates ramp sequences of the bypass digital value, the ramp sequences being gradually increasing or decreasing sequences of the bypass digital value that cause the bypass DAC to gradually increase or decrease the bypass current over a ramp period of time; and switch controller means for abruptly switching the first digital input from a low digital value that causes the first DAC to generate a first current that is insufficient to illuminate the first LED, to a high digital value that causes the first DAC to generate a first current that is sufficient to illuminate the first LED, and for abruptly switching the bypass digital input from a high digital value to a low digital value, wherein the bypass current is gradually ramped up and down when the first current is not causing the first LED to illuminate, and wherein both the first current and the bypass current are abruptly switched when the first LED is illuminated or de-illuminated, wherein the sum current is not abruptly changed, whereby the sum current is gradually ramped but the first current and the bypass current are abruptly switched when the first LED is illuminated.

2. The DAC-switched LED driver of claim 1 further comprising:

a second LED path having a second LED and a second DAC in series between the sum node and the supply node;

a second digital input to the second DAC, the second digital input for carrying a second digital value, the second DAC generating a second current through the second LED, the second current being a function of the second digital value.

3. The DAC-switched LED driver of claim 2 wherein the switch controller means further comprises LED swap means for abruptly switching the first digital input from the high digital value to the low digital value at a same time as switching the second digital input from the low digital value to the high digital value, wherein current is swapped between the first LED and the second LED without adjusting the sum current.

4. The DAC-switched LED driver of claim 3 wherein the ramp period of time is at least five times longer than a switch period of time for the first current to change when the high digital value abruptly replaces the low digital value to the first DAC.

5. The DAC-switched LED driver of claim 3 wherein the ramp period of time is at least ten times longer than a switch period of time for the first current to change when the high digital value abruptly replaces the low digital value to the first DAC.

6. The DAC-switched LED driver of claim 1 further comprising:

a first analog input to the first DAC, the first analog input being an analog reference, wherein the first current is a function of the first analog input.

7. The DAC-switched LED driver of claim 1 wherein the supply node is ground.

8. The DAC-switched LED driver of claim 2 further comprising:

a third LED path having a third LED and a third DAC in series between the sum node and the supply node;

a third digital input to the third DAC, the third digital input for carrying a third digital value, the third DAC generating a third current through the third LED, the third current being a function of the third digital value.

9. The DAC-switched LED driver of claim 8 wherein the first LED outputs red visible light in response to the first current being generated by the first DAC from the high digital value;

wherein the second LED outputs green visible light in response to the second current being generated by the second DAC from the high digital value;

wherein the third LED outputs blue visible light in response to the third current being generated by the third DAC from the high digital value, whereby red, green, and blue visible light is generated.

10. A shared digital-to-analog converter (DAC) light-emitting diode (LED) driver comprising:

a first supply node;

a second supply node;

a summing current DAC coupled to the second supply node and to an intermediate node, the summing current DAC generating a sum current in response to a digital value applied to a digital input of the summing current DAC, the summing current DAC also having an analog reference input;

a first path, coupled between the first supply node and the intermediate node, the first path having a first LED and a first switch in series, wherein the first switch opens and closes in response to a first control signal to enable and disable current flow through the first LED;

a second path, coupled between the second supply node and the intermediate node, the second path having a second LED and a second switch in series, wherein the second switch opens and closes in response to a second control signal to enable and disable current flow through the second LED;

a bypass path, coupled between the first supply node and the intermediate node, the bypass path having a bypass switch, wherein the bypass switch opens and closes in response to a bypass control signal to enable and disable current flow through the bypass path;

a ramp-up sequencer that generates an ascending sequence of digital values that are applied to the summing current DAC to gradually increase the sum current before the first LED or the second LED is switched on;

a ramp-down sequencer that generates a descending sequence of digital values that are applied to the summing current DAC to gradually decrease the sum current after the first LED or the second LED is switched off; and a switch controller, activated after the ramp-up sequencer has finished causing the summing current DAC to increase the sum current to a target value, and before the ramp-down sequencer has started causing the summing current DAC to decrease the sum current to a zero value, the switch controller activating the first control signal to close the first switch and de-activating the bypass control signal to open the bypass switch in response to a first-LED activation signal; the switch controller activating the second control signal to close the second switch and de-activating the bypass control signal to open the bypass switch in response to a second-LED activation signal, whereby control signals are switched after the ramp-up sequencer has ramped the sum current to the target value, and before the ramp-down sequencer has ramped the sum current down to the zero value.

11. The shared DAC LED driver of claim 10 wherein the first supply node is driven by a DC-DC converter, and wherein the second supply node is a ground.

12. The shared DAC LED driver of claim 10 wherein the ramp-up sequencer and the ramp-down sequencer comprise:

a target register for storing a target digital value;

a counter for incrementing or decrementing a current digital value that is currently applied to the summing current DAC; and a comparator for comparing the current digital value from the counter to the target digital value in the target register and for halting incrementing or decrementing of the counter when the current digital value is equal to the target digital value.

13. The shared DAC LED driver of claim 12 wherein the switch controller comprises:

a first register for storing a first digital value that is applied to the summing current DAC when the first LED is illuminated in a first mode;

a second register for storing a second digital value that is applied to the summing current DAC when the second LED is illuminated in the first mode;

wherein the switch controller activates the ramp-up sequencer to generate the ascending sequence of digital values from the first digital value to the second digital value when the second digital value is greater than the first digital value;

wherein the switch controller activates the ramp-down sequencer to generate the descending sequence of digital values from the first digital value to the second digital value when the second digital value is less than the first digital value.

14. The shared DAC LED driver of claim 13 wherein the switch controller further comprises:

a first alternate register for storing a first alternate digital value that is applied to the summing current DAC when the first LED is illuminated in an alternate mode;

a second alternate register for storing a second alternate digital value that is applied to the summing current DAC when the second LED is illuminated in the alternate mode;

wherein the alternate mode is activated when the first LED and the second LED are illuminated in a power-savings mode that produces a lower first current than does the first mode.

15. The shared DAC LED driver of claim 14 further comprising:

pipeline logic for generating a preview signal that is activated before the first control signal is activated, the preview signal activating the ramp-up sequencer to cause the summing current DAC to ramp up the sum current before the first LED is illuminated.

16. A current-shifting light-emitting diode (LED) driver comprising:

a power converter providing a sum current onto a power node;

a first digital-to-analog converter (DAC) for generating a first current in response to a first digital input;

a first path from the power node to a ground, the first path having a first LED and the first DAC in series, the first DAC generating the first current through the first LED;

a second DAC for generating a second current in response to a second digital input;

a second path from the power node to the ground, the second path having a second LED and the second DAC in series, the second DAC generating the second current through the second LED; and a bypass DAC for generating a bypass current in response to a bypass digital input, the bypass DAC connected between the power node and the ground.

17. The current-shifting LED driver of claim 16 further comprising:

a sequence generator that generates a ramp sequence of bypass digital values applied to the bypass digital input to ramp the bypass current to a target current before the first LED or the second LED are illuminated; and a current shifter that swaps a target digital value on the bypass digital input with a zero digital value on the first digital input after the sequence generator applies the ramp sequence to the bypass DAC to achieve the target current, whereby the target current is reached by the ramp sequence applied to the bypass DAC before the target digital value is shifted to the first DAC and the bypass DAC is zeroed.

18. The current-shifting LED driver of claim 17 further comprising:

look-ahead logic that examines a data stream to generate a preview signal sufficiently before the first LED is to be illuminated, the preview signal activating the sequence generator and the bypass DAC to ramp the bypass current up to the target current before the first LED is illuminated.

19. The current-shifting LED driver of claim 18 wherein the first DAC comprises:

a first high-power register for storing a first digital value for a high-power mode;

a first low-power register for storing a first digital value for a low-power mode;

a first mux controlled by a power mode select signal to route the first digital value from the first high-power register to the first digital input of the first DAC when the power mode select signal indicates the high-power mode, and to route the first digital value from the first low-power register to the first digital input of the first DAC when the power mode select signal indicates the low-power mode.

20. The current-shifting LED driver of claim 17 further comprising:

control means for gradually increasing the sum current from a zero current to the target current over a ramp period of time by ramping the bypass DAC with the ramp sequence of the bypass digital values when the first LED and the second LED are disabled by the first DAC and the second DAC, then abruptly shifting current by activating the first DAC and disabling the bypass DAC to illuminate the first LED, then abruptly shifting current by activating the bypass DAC and disabling the first DAC, then gradually decreasing the sum current from the target current to the zero current over the ramp period of time by ramping the bypass DAC with an inverse of the ramp sequence of the bypass digital values when the first LED and the second LED are disabled by the first DAC and the second DAC.

* * * * *